United States Patent [19]

Bradley

[11] Patent Number: 4,600,151

[45] Date of Patent: Jul. 15, 1986

[54] FUEL INJECTOR ASSEMBLY WITH WATER OR AUXILIARY FUEL CAPABILITY

[75] Inventor: Jerome R. Bradley, Sterling Heights, Mich.

[73] Assignee: Ex-Cell-O Corporation, Troy, Mich.

[21] Appl. No.: 444,015

[22] Filed: Nov. 23, 1982

[51] Int. Cl.[4] ..... B05B 7/10

[52] U.S. Cl. ..... 239/400; 239/404; 239/406; 239/422; 239/424

[58] Field of Search ..... 239/400, 404, 405, 406, 239/422, 424

[56] References Cited

U.S. PATENT DOCUMENTS

| | | | |
|---|---|---|---|
| 783,898 | 2/1905 | Scherding | 239/403 |
| 3,937,011 | 2/1976 | Caruel et al. | 239/406 |
| 3,980,233 | 9/1976 | Simmons et al. | 239/406 |

FOREIGN PATENT DOCUMENTS

| | | | |
|---|---|---|---|
| 1099959 | 1/1968 | United Kingdom | 239/400 |
| 1501679 | 2/1978 | United Kingdom . | |
| 2055186 | 2/1981 | United Kingdom . | |
| 559730 | 8/1977 | U.S.S.R. | 239/424 |

*Primary Examiner*—Joseph F. Peters, Jr.
*Assistant Examiner*—Michael F. Forman
*Attorney, Agent, or Firm*—Edward J. Timmer

[57] ABSTRACT

An air-blast fuel injector assembly for a gas turbine engine includes an annular shroud means operatively associated with a plurality of sleeve means one inside the other in spaced apart relation. The sleeve means form a liquid fuel-receiving chamber, a water or auxiliary fuel-receiving chamber inside the liquid fuel-receiving chamber for discharging water or auxiliary fuel in addition or alternatively to the liquid fuel, an inner air-receiving chamber for receiving and directing compressor discharge air into the fuel spray cone and/or water or auxiliary fuel to mix therewith from the inside. The shroud means forms an outer air-receiving chamber for receiving and directing other compressor discharge air into the fuel spray cone and/or water or auxiliary fuel from the outside for mixing purposes.

5 Claims, 1 Drawing Figure

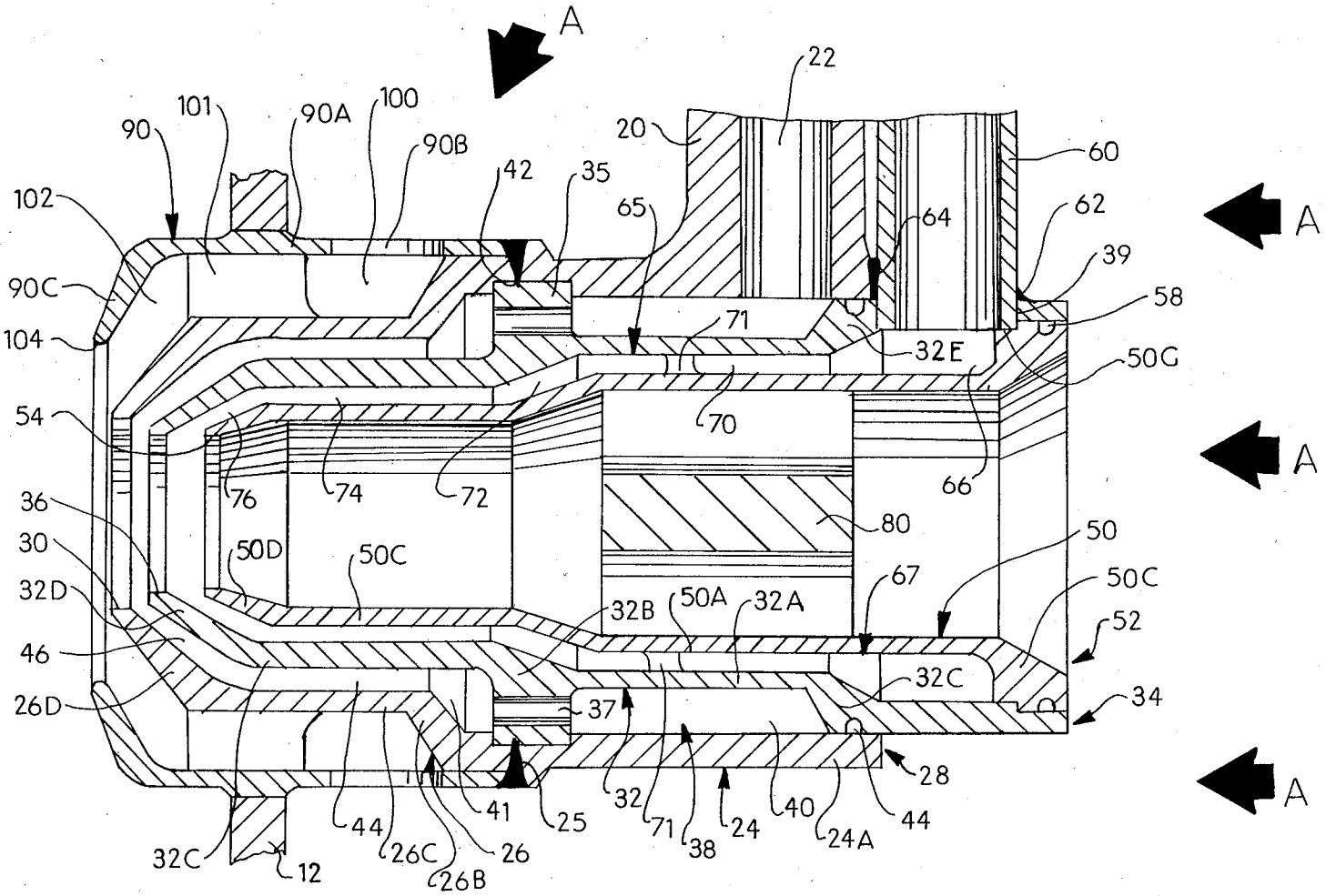
A
A
A
A
58
50G
60
62
39
50
50C
52
34
66
32E
64
32C
28
44
80
67
22
24A
40
32A
24
71
70
50A
38
20
65
32B
32
71
37
35
25
42
41
26
72
26B
90B
26C
100
50C
44
74
90A
12
76
50D
101
32C
90
102
90C
104
54
36
30
32D
46
26D

FUEL INJECTOR ASSEMBLY WITH WATER OR AUXILIARY FUEL CAPABILITY

FIELD OF THE INVENTION

The present invention relates to a fuel nozzle, especially of the dual or alternate fuel type, for use in gas turbine engines and other turbine type power plants.

BACKGROUND OF THE INVENTION

Dual fuel nozzles are known for use in gas turbine engines for such purposes as smoke reduction by injecting water along with the fuel, minimization of carbon formation and build-up on the fuel nozzle, suppression of nitrogen oxide formation during the combustion process and thrust augmentation.

The Coburn et al. U.S. Pat. No. 4,290,558 issued Sept. 27, 1981 discloses a gas turbine fuel nozzle and support assembly capable of operating in a fuel/water injection mode for smoke reduction purposes. Water is injected from a passage in the nozzle support into a space between the support and heat shield behind the nozzle and is carried through a plurality of nozzle passages extending from the nozzle exterior to an inner annular chamber. In the nozzle, the water is subjected to a centrifuging action in the annular chamber for eventual discharge around the outside of the fuel spray cone which is discharged from primary and secondary fuel orifices.

The Stratton U.S. Pat. No. 4,311,277 issued Jan. 19, 1982 discloses a fuel nozzle and support assembly for use with external air swirler blades in a flame tube. The assembly includes gaseous fuel supply passages and orifices located external of the liquid fuel passages and orifices and operable in one mode when the liquid fuel supply is discontinued. In another mode, the gaseous fuel supply is interrupted when the liquid fuel is supplied to the nozzle.

So-called piloted air blast or dual orifice fuel nozzles for gas turbine engines are shown in the Helmrich U.S. Pat. No. 3,684,186 issued Aug. 15, 1972 and the Simmons U.S. Pat. No. 4,139,157 issued Feb. 13, 1979. These types of fuel nozzles are not designed to use dual fuels but rather have a primary fuel supply system providing a low fuel flow rate for engine start-up and high altitude conditions and a secondary fuel supply system capable of high fuel flow rates for high engine power conditions. During high engine power conditions, the primary fuel flow may be maintained at the start-up rate, reduced to a lower rate, or possibly shut off. In fact, air-blast fuel nozzles having only a secondary fuel system but nevertheless operable over most engine power conditions have been used and are shown, for example, in FIG. 2 of the Helmrich U.S. Pat. No. 3,684,186 referred to above and the Simmons et al. U.S. Pat. No. 3,980,233 issued Sept. 14, 1976.

Other fuel nozzle and support assembly constructions for use in gas turbine engines are illustrated in U.S. Pat. No. 2,701,164 issued Feb. 1, 1955; U.S. Pat. No. 3,520,480 issued July 14, 1970; U.S. Pat. No. 3,638,865 issued Feb. 1, 1972; U.S. Pat. No. 3,662,959 issued May 16, 1972; U.S. Pat. No. 3,662,959 issued May 16, 1972; U.S. Pat. No. 3,662,960 issued May 16, 1972 and U.S. Pat. No. 3,675,853 issued July 11, 1972.

SUMMARY OF THE INVENTION

It is an object of the present invention to provide an air blast fuel injector assembly useful in gas turbine engines and having the capability to operate in dual fuel, alternate fuel or fuel/water injection modes.

It is another object of the invention to provide such a fuel injector assembly with means for operating in such modes and which does not interfere with normal operation of the fuel injector on a single source of liquid fuel.

It is still another object of the invention to provide such a fuel injector assembly which, in one mode of operation, can use auxiliary liquid or gaseous fuel in addition or alternatively to the normal liquid fuel, the gaseous fuel capability being especially useful for engine start-up.

It is yet another object of the invention to provide such a fuel injector assembly for purposes of thrust augmentation and emissions reduction which is simple in design.

In a typical working embodiment of the invention, the air-blast fuel injector assembly comprises an annular shroud means and a plurality of sleeve means disposed one inside the other in spaced relation to form a liquid fuel-receiving chamber, a water or auxiliary fuel-receiving chamber inside the liquid-fuel receiving chamber and an inner air-receiving chamber for receiving and directing compressor discharge air into the fuel spray cone and/or water or auxiliary fuel from the inside for atomizing or mixing with same. The shroud means forms, with one of the sleeve means, an outer air-receiving chamber disposed exteriorly for receiving and directing other compressor discharge air into the fuel spray cone and/or water or auxiliary fuel from the outside for atomizing or mixing with same.

In preferred embodiments, first, second and third sleeve means are provided with the second sleeve means inside the first and the third sleeve means inside the second in spaced apart relation with each sleeve means having a downstream end with an annular lip disposed upstream from the surrounding sleeve means. The first and second sleeve means form the liquid fuel-receiving chamber from which liquid fuel is discharged at the downstream end over the annular lip of the first sleeve means. The second and third sleeve means form the water or auxiliary fuel-receiving chamber from which water or auxiliary fuel is discharged over the annular lip of the second sleeve means. The third sleeve means forms the inner air-receiving chamber while the shroud means is disposed externally around the first sleeve means to form the outer air-receiving chamber.

In a particularly preferred embodiment, the upstream ends of the second and third sleeve means extend upstream past the upstream end of the first sleeve means and include portions forming supply means in communication with the water or auxiliary fuel-receiving chamber for supplying water or auxiliary fuel thereto.

Preferably, the supply means comprises an aperture through the second sleeve means and an adjacent shoulder on portions of the third sleeve means with a water or auxiliary fuel supply tube means extending through the aperture and seated on the shoulder, preferably brazed or otherwise metallurgically attached to the second sleeve means.

In an even more preferred embodiment, the first sleeve means includes a liquid fuel supply tube means adjacent the water or auxiliary fuel supply tube means where the tube means enter the fuel injector.

The fuel injector assembly of the invention is advantageous in that either water, or liquid or gaseous auxiliary fuel can be injected through the same supply means in addition to or alternatively to normal liquid fuel in another supply means for purposes of thrust augmentation, emission reductions or engine start-up on an as-needed basis and in that the water or auxiliary fuel supply means arrangement does not interfere with normal performance or operation of the fuel injector on the liquid fuel.

BRIEF DESCRIPTION OF THE DRAWING

The FIGURE is a cross-sectional view along the longitudinal axis of the fuel injector assembly of the invention.

DESCRIPTION OF PREFERRED EMBODIMENTS

Referring to the FIGURE, the fuel injector assembly of the invention is generally designated at 10 and is mounted in a gas turbine engine combustion chamber partially indicated at 12 in usual prior art fashion. The fuel injector assembly 10 is of the air-blast type using compressor discharge airstream, A, flowing from the upstream compressor toward the downstream combustion chamber 12 as shown by the arrows and as is well known in the art, for example, as shown in FIG. 1 of U.S. Pat. No. 3,980,233.

The fuel injector assembly is shown as including a support member 20 with a liquid fuel supply passage 22 which constitutes the normal or primary fuel for the gas turbine engine. A sleeve portion 24 extends from the support member and is brazed, welded or otherwise metallurgically attached at 25 to another sleeve portion 26 so that, together, sleeve portions 24, 26 form a first sleeve member with an upstream end 28 and a downstream end with a first annular lip 30 with a longitudinal bore therebetween as shown.

Disposed within the first sleeve member 24, 26 is a second sleeve member 32 having an upstream end 34 and a downstream end with a second annular lip 36 located upstream or axially inward from the first annular lip 30 and with a longitudinal bore between the ends as shown. It is apparent that the second sleeve member 32 has portions spaced from the first sleeve member 24, 26 to define a generally annular liquid fuel-receiving chamber 38 therebetween. In particular, the liquid fuel-receiving chamber includes an annular manifold chamber 40 in communication with liquid fuel supply passage 22. The second sleeve member includes an annular collar 35 received in a suitable annular recess in first sleeve member 24, 26 and providing circumferentially spaced fuel ports 37 between the manifold chamber 40 and frusto-conical chamber 41, the ports 37 being angled relative to the longitudinal axis of the assembly to discharge the fuel in a swirling motion into chamber 41, annular chamber 44 and frusto-conical chamber 46 between the subject sleeve members 24, 26 and 32. Of course, the liquid fuel flows past the first annular lip 30 to form a fuel spray cone discharging into the combustion chamber. The fuel ports 37 are of predetermined size whereby the fuel will flow at certain rates depending upon the fuel pressure so as to follow a desired fuel flow curve. The second sleeve member 32 is attached to the first sleeve member 24, 26 by brazing or welding at 42 and 44, the brazing at 44 on outwardly flared flange **32*e* of the second sleeve member closing off the open upstream end of the first sleeve member to form fuel manifold chamber 40**.

It is apparent that first sleeve member 24, 26 and second sleeve member 32 have cylindrical tubular portions **24*a*, 32*a*, frusto-conical portions 26*b*, 32*b*, cylindrical tubular portions 26*c*, 32*c*, frusto-conical portions 26*c*, 32*c*** corresponding generally with one another along the length or longitudinal axis of the fuel injector assembly to form the desired chambers for liquid fuel flow. In particular, the frusto-conical portion provides a liquid fuel swirl chamber therebetween for use with the manifold chamber and fuel ports.

The third sleeve member 50 is shown disposed in spaced relation inside the second sleeve member 32. The third sleeve member has an open upstream end 52 and a downstream end with a third annular lip 54 located upstream or axially inward from second annular lip 36 and with a longitudinal bore between the ends. The third sleeve member includes at its upstream end an outwardly flared, annular flange **50*e* brazed at 58 to the cylindrical upstream end of second sleeve member 32. Third sleeve member 50 includes a cylindrical tubular portion 50*a* which extends to frusto-conical portion 50*b*. Frusto-conical portion 50*b* merges with another cylindrical tubular portion 50*c* followed by frusto-conical portion 50*d* and corresponds in general location to similar portions of the second sleeve member 32** along the length of the fuel injector assembly.

It is apparent that the upstream ends 34, 52 of the second and third sleeve members 32, 50 extend upstream past the upstream end 28 of the first sleeve member. As shown, the upstream end 34 of the second sleeve member 32 is provided with a circular hole 39 adapted to receive a supply tube 60 connected to a source (not shown) of water or auxiliary fuel which may be liquid or gaseous as the situation demands. The flange **50*e* of third sleeve member 50 is shown including a circumferential shoulder 50*g* on which a portion of the end of supply tube 60 is seated. The supply tube 60 is fixed to the fuel injector assembly by brazing, welding or otherwise metallurgically attaching the tube at 62 to the second sleeve member and at 64 to the second member and the adjacent portion of the first sleeve member 24**.

It is apparent that water or auxiliary fuel can be supplied, when desired, through supply tube 60 into the chamber 65 which includes an initial manifold chamber 66. The water or auxiliary fuel will flow through the chamber 65 between the second sleeve member 32 and third sleeve member 50, e.g. from manifold chamber 66 to cylindrical tubular chamber 70 having swirl vanes 71, then to frusto-conical chamber 72, then to cylindrical tubular chamber 74 and finally to frusto-conical chamber 76 over second annular lip 36. The water or auxiliary fuel can flow past lip 36 into the fuel spray cone (issuing from lip 30) from the inside of the fuel spray cone. Or the auxiliary fuel can be discharged past lip 36 as an auxiliary fuel spray cone or gaseous fuel flow when no liquid fuel is issuing from lip 30; i.e., in the alternate fuel mode of operation. For example, during engine start-up, gaseous fuel may be discharged past lip 36 with no other fuel supplied to the engine.

Compressor discharge air A is received by the third sleeve member 50 and conveyed therethrough and past swirl vanes 80 and third annular lip 54 into the fuel spray cone and/or the water or auxiliary fuel being injected. The air passing over lip 54 enters into the fuel spray cone and/or water or auxiliary fuel spray cone from the inside to atomize same or intermix with same in the case of auxiliary gaseous fuel.

Compressor discharge air is also discharged into the fuel spray cone from the outside thereof by shroud member 90 which is disposed externally of and spaced from first sleeve member 26 and which has an open upstream end into which the first sleeve member 26 extends as shown. The upstream shroud end is brazed or welded to the first sleeve member at 25 where the sleeve portions 24, 26 are attached together with collar 32*a* of the second sleeve member 32. This joining arrangement is advantageous since one brazing or welding operation joins the sleeve portions 24, 26, second sleeve member 32 and shroud member 90.

The cylindrical tubular portion 90*a* of the shroud member includes a plurality of air entrance slots 90*b* to receive compressor discharge air. The air enters an air manifold chamber 100 formed between the cylindrical tubular portions 90*a*, 26*c* of the shroud member and first sleeve member 26 and past swirl vanes 101. Thereafter, the air enters the frusto-conical air swirl chamber 102 formed between the corresponding frusto-conical portions 90*c*, 26*d* of the shroud member and inner sleeve member 26 and finally flows past the annular shroud lip 104 into the fuel spray cone and/or water or auxiliary fuel from the outside to atomize or intermix with same in conjunction with the air flowing past lip 54.

It will be observed that the swirl vanes in conjunction with the frusto-conical chambers for fuel, water or air will increase the velocity and therefore the centrifugal forces on the substance flowing therethrough. In the nozzle assembly described, the fuel, water or air swirls or rotates in the same general direction.

In operation without water or auxiliary fuel, the supply tube 60 is simply shut off by suitable known valve means or the like and only liquid fuel supplied by fuel passage 22 will be burned. This fuel will be discharged into the combustion chamber as a fuel spray cone from lip 30 with air from lips 54 and 104 intermixing therewith from the inside and outside, respectively and atomizing the fuel. The presence of the third sleeve member 50 will have no adverse effect on the performance of the fuel injector in this mode of operation.

When thrust augmentation or emissions reduction is desired, water or auxiliary fuel will be supplied through tube 60 and discharged from lip 36 in a water spray cone or auxiliary fuel spray cone to intermix with the liquid fuel spray cone issuing from lip 30. Of course, compressor discharge air will intermix with the fuel spray cone and other spray cone from the inside and outside by discharge past lips 54 and 104, respectively. During engine start-up, gaseous fuel may be introduced through tube 60 and discharged from lip 36 with no liquid fuel discharging from lip 30. After start-up, the liquid fuel may be supplied through passage 22 with the flow of gaseous fuel being most likely discontinued thereafter. The injector assembly of the invention thus eliminates the need for special gaseous fuel supply and injector means during start-up.

In either mode of operation, the volume of air flowing, the ratio of air to fuel and the relative axial locations of the lips 30, 36, 54, 104 will be so chosen as to achieve optimum mixing of the fuel/air/water to obtain a proper fuel/air/water ratio for thrust augmentation and/or emissions reductions.

While the invention has been described by a detailed description of certain specific and preferred embodiments, it is understood that various modifications and changes can be made in any of them within the scope of the appended claims which are intended to also include equivalents of such embodiments.

I claim:

1. An air-blast fuel injector assembly useful in the compressor discharge airstream of a gas turbine power plant comprising:

(a) a first sleeve means having a first longitudinal bore therethrough and having an open downstream end with a first annular lip and an upstream end;

(b) a second sleeve means disposed inside said first sleeve means, said second sleeve means having a second longitudinal bore therethrough and having an open downstream end with a second annular lip disposed upstream from said first annular lip and an upstream end, portions of said second sleeve means being spaced from said first sleeve means to form an annular liquid fuel-receiving chamber therebetween extending toward said first and second lips where the chamber opens for discharging liquid fuel over said first lip to form a fuel spray cone;

(c) a third sleeve means disposed inside said second sleeve means, said third sleeve means having a third longitudinal bore therethrough and having an open downstream end with a third annular lip disposed upstream from said second lip and an open upstream end, portions of said third sleeve means being spaced from said second sleeve means to form an annular water or auxiliary fuel-receiving chamber therebetween disposed inside relative to said liquid fuel-receiving chamber and extending toward said second and third lips where said chamber opens for discharging water or auxiliary fuel over said second lip in addition or alternatively to said liquid fuel, said third sleeve means receiving compressor discharge air through its open upstream end for discharge over said third lip to intermix with the fuel spray cone and/or water or auxiliary fuel from the inside, and (d) an annular shroud means disposed exteriorly of said first sleeve means, said shroud means having a longitudinal bore therethrough and having an open downstream end with an annular shroud lip disposed downstream from said first lip and an upstream end into which said first sleeve means extends, portions of said shroud means being spaced from said first sleeve means to form an annular air-receiving chamber disposed exteriorly around said first sleeve means and extending downstream toward said shroud lip where said air-receiving chamber opens for discharging air over said shroud lip to intermix with the fuel spray cone and/or water or auxiliary fuel from the outside and other portions of said shroud means forming aperture means for receiving compressor discharge air.

2. The air-blast fuel injector assembly of claim 1 wherein the upstream end of said second sleeve means and the upstream end of said third means extend upstream past the upstream end of said first sleeve means and include portions forming supply means in communication with said annular water or auxiliary fuel-receiving chamber for supplying water or auxiliary fuel thereto when desired.

3. The air-blast fuel injector assembly of claim 2 wherein the supply means comprises an aperture in said second sleeve means, an adjacent shoulder on portions of said third sleeve means and first supply tube means extending through said aperture and seated on said shoulder for supplying water or auxiliary fuel, when required, to said annular water or auxiliary fuel-receiving chamber.

4. The air-blast fuel injector assembly of claim 3 wherein the tube means is metallurgically attached to said second sleeve means.

5. The air-blast fuel injector assembly of claim 3 wherein said first sleeve means includes liquid fuel supply tube means in communication with said liquid fuel-receiving chamber, said liquid fuel tube means being adjacent said first supply tube means where said tube means enter said fuel injector assembly.

* * * * *